United States Patent [19]

Ganley

[11] Patent Number: 4,896,862

[45] Date of Patent: Jan. 30, 1990

[54] METHOD OF OPERATING A SCREW-PROPELLED RESCUE TOOL

[76] Inventor: Robert F. Ganley, 615 Mallard Rd., Wayne, Pa. 19087

[21] Appl. No.: 319,794

[22] Filed: Mar. 6, 1989

Related U.S. Application Data

[62] Division of Ser. No. 185,401, Apr. 22, 1988, abandoned.

[51] Int. Cl.[4] ..... B66F 3/10

[52] U.S. Cl. ..... 254/1; 254/100; 72/705; 72/392

[58] Field of Search ..... 254/100, 126, 103, DIG. 2, 254/1; 29/261, 262, 426.5; 72/392, 705; 30/134, 228, 245, 92, 260, 345; 7/100; 83/701

[56] References Cited

U.S. PATENT DOCUMENTS

| | | | |
|---|---|---|---|
| 1,638,859 | 8/1927 | Knowles | 254/126 |
| 1,814,368 | 7/1931 | Chapman | 29/262 |
| 2,541,964 | 2/1951 | Hennings | 254/100 |
| 2,589,572 | 3/1952 | Rainwater | 254/126 |
| 2,597,103 | 5/1952 | Johnson et al. | 72/392 |
| 2,606,469 | 8/1952 | Morgenthaler | 72/392 |
| 3,606,252 | 9/1971 | Dorough | 254/DIG. 2 |
| 3,819,153 | 6/1974 | Hurst . | |
| 4,157,171 | 6/1979 | Hasselas | 254/100 |
| 4,333,330 | 6/1982 | Porter . | |
| 4,392,263 | 7/1983 | Amoroso . | |
| 4,531,289 | 7/1985 | Brick . | |

*Primary Examiner*—Robert C. Watson

*Attorney, Agent, or Firm*—William H. Eilberg

[57] ABSTRACT

A rescue tool has a pair of arms which are opened and closed by rotating a threaded member. The arms are pivotably connected together, and are also connected to a common yoke. The yoke is connected to a piston, which is mounted within a frame. Movement of the piston along its longitudinal axis causes the arms to open and close. The piston is connected to a collar which screws onto a threaded member. Rotation of the threaded member therefore causes the piston to move back and forth along its longitudinal axis, and opens or closes the arms. The threaded member can be connected to an external source of power, such as a pneumatic, hydraulic, or electric motor. Alternatively, the threaded member can be rotated by a hand-operated crank. The rescue tool can be connected to a variety of different power sources, without modifying the internal structure of the tool. Because the power source is coupled to the arms through a threaded member, the arms can be moved with great precision. The invention thus reduces the risk of causing unintended harm to an accident victim.

6 Claims, 2 Drawing Sheets

METHOD OF OPERATING A SCREW-PROPELLED RESCUE TOOL

This application is a division of application Ser. No. 185,401, filed Apr. 22, 1988, now abandoned.

BACKGROUND OF THE INVENTION

This invention relates to the field of high-power rescue tools. The invention provides a rescue tool which may be used with a variety of different sources of power, and which can be operated with great precision.

High-power rescue tools have been known for a long time. Examples of rescue tools are shown in U.S. Pat. Nos. 3,819,153, 4,392,263, and 4,531,289. The disclosures of the latter patents are incorporated by reference herein.

High-power rescue tools are used to extricate accident victims who are trapped within the wreckage of automobiles or other heavy vehicles. A rescue must be done rapidly, so that the victim can be quickly moved to a hospital. But speed is not enough; the rescue must also be done with sufficient care to prevent additional harm to the victim.

Rescue tools generally include a pair of arms, mounted to pivot around a common point of connection. The arms therefore move apart and together, under the influence of a driven piston. Most rescue tools include a pair of metal blades, attached to or forming part of the arms, the blades being sufficiently strong to cut through heavy metal. Opening and closing of the arms therefore enables the tool to cut like a scissors.

Rescue tools may also include other attachments. For example, some tools have a pair of work jaws attached to the ends of the arms. The work jaws can be used for prying, pulling, or lifting. The pulling function is accomplished by attaching cables to holes in the work jaws, so that movement of the arms pulls the cables with sufficient force to move a heavy object.

Most of the rescue tools of the prior art have been hydraulically powered. For example, U.S. Pat. No. 4,531,289 discloses a system of valves for directing hydraulic fluid to either side of a piston, thereby causing the arms of the tool to move apart or come together. Rescue tools have also been powered by pneumatically-driven motors, or by electric motors.

In general, each rescue tool of the prior art is specifically designed to be operated with only one kind of power source. For hydraulically-operated tools, it is usually necessary to provide a separate power unit, between the rescue tool and the reservoir of hydraulic fluid. It is difficult, if not impossible, to operate a rescue tool of the prior art with a power unit for which the tool was not originally intended.

Another disadvantage of rescue tools of the prior art is their lack of precision. When an accident victim is tightly trapped within the wreckage of an automobile, the process of extricating the victim often must be performed with surgical precision. A slight error in the movement of the arm can cause serious harm to the victim. It is not uncommon for the victim to survive the accident, but be endangered by a false motion of the tool. Thus, it is important that the cutting and prying be very precisely controllable.

Rescue tools of the prior art are not precision instruments. They are designed primarily to generate large cutting forces, but not to apply those forces in a controlled manner. The tools of the prior art are typically capable of generating very large forces, of the order of 40,000 pounds or more. When the power unit of such a tool is turned on, the arms will likely start to move with a jerk, and often overshoot their intended destination. It is therefore very difficult, if not impossible, to move the arm of a rescue tool, from a position of rest, through a short distance, in a controlled manner.

The present invention solves the above-described problems, by providing a tool in which the source of power is coupled to the arms by a threaded member. The threaded coupling makes the tool extremely versatile, as the tool can be powered by virtually any existing power source, without modifying the tool's internal structure. Also, the threaded coupling enables the tool to move with the precision necessary to prevent unintended harm to an accident victim.

SUMMARY OF THE INVENTION

The rescue tool of the present invention has a pair of arms which are pivotably connected together, and which can be moved apart and together by a reciprocating piston. The arms may include blades and/or other attachments. The piston is moved by a threaded member which is connected, through a threaded collar, to the piston. Rotation of the threaded member causes the collar to move along the threaded member. The threaded member is fixed, so that rotation of the threaded member causes the piston to move along its longitudinal axis, forcing the arms apart or together.

The rescue tool can be powered by a pneumatic, hydraulic, or electric power source. It is also possible to use a hand-operated crank, the latter alternative being especially useful where extra precision is needed. All of these power sources can be used with the same tool, without modifying the internal components of the tool. In all cases, the threaded member converts the input power into a controlled and powerful piston stroke.

The external power source can be connected to the threaded member through a gear, which transmits power through a 90° angle. Alternatively, the power source can be coupled directly to the threaded member.

It is therefore an object of the present invention to provide an improved high-power rescue tool.

It is another object of the invention to provide a rescue tool having arms which are moved by the rotation of a threaded member.

It is another object to provide a rescue tool, wherein the same tool can be easily connected to a variety of sources of power.

It is another object to provide a rescue tool in which the arms can be controllably moved through a small distance, thereby making it possible to use the tool to move or cut through metal with great precision.

It is another object of the invention to make it easier to perform rescue operations.

It is another object of the invention to reduce the risk of harm, to an accident victim, from the rescue operation itself.

Other objects and advantages of the present invention will be apparent to those skilled in the art, from a reading of the following brief description of the drawings, the detailed description of the invention, and the appended claims.

DETAILED DESCRIPTION OF THE INVENTION

Figure 1:
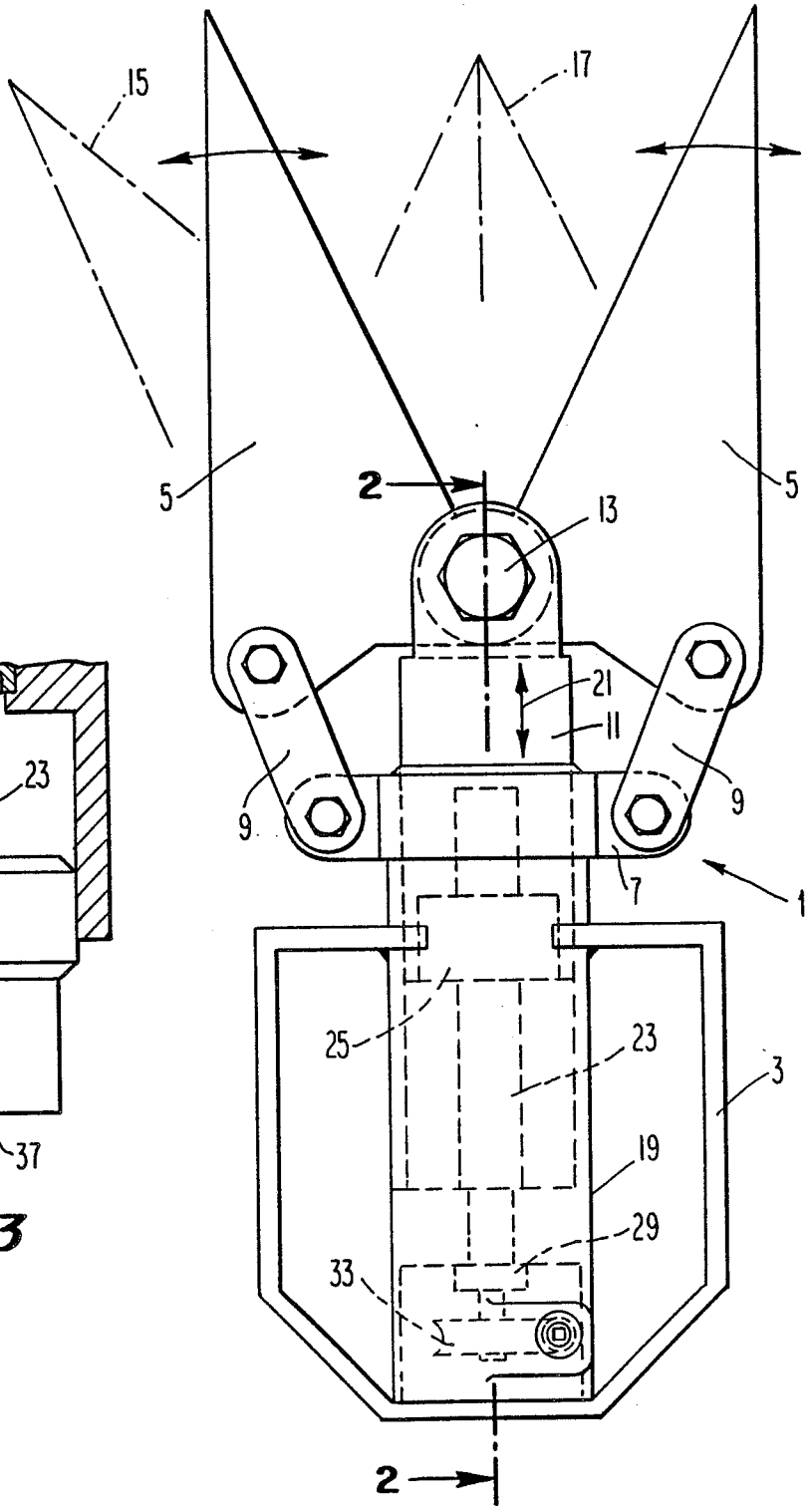
FIG. 1 is a side elevational view of the rescue tool of the present invention, showing the arms and the handle, and indicating the drive members in dotted outline.
Figure 2:
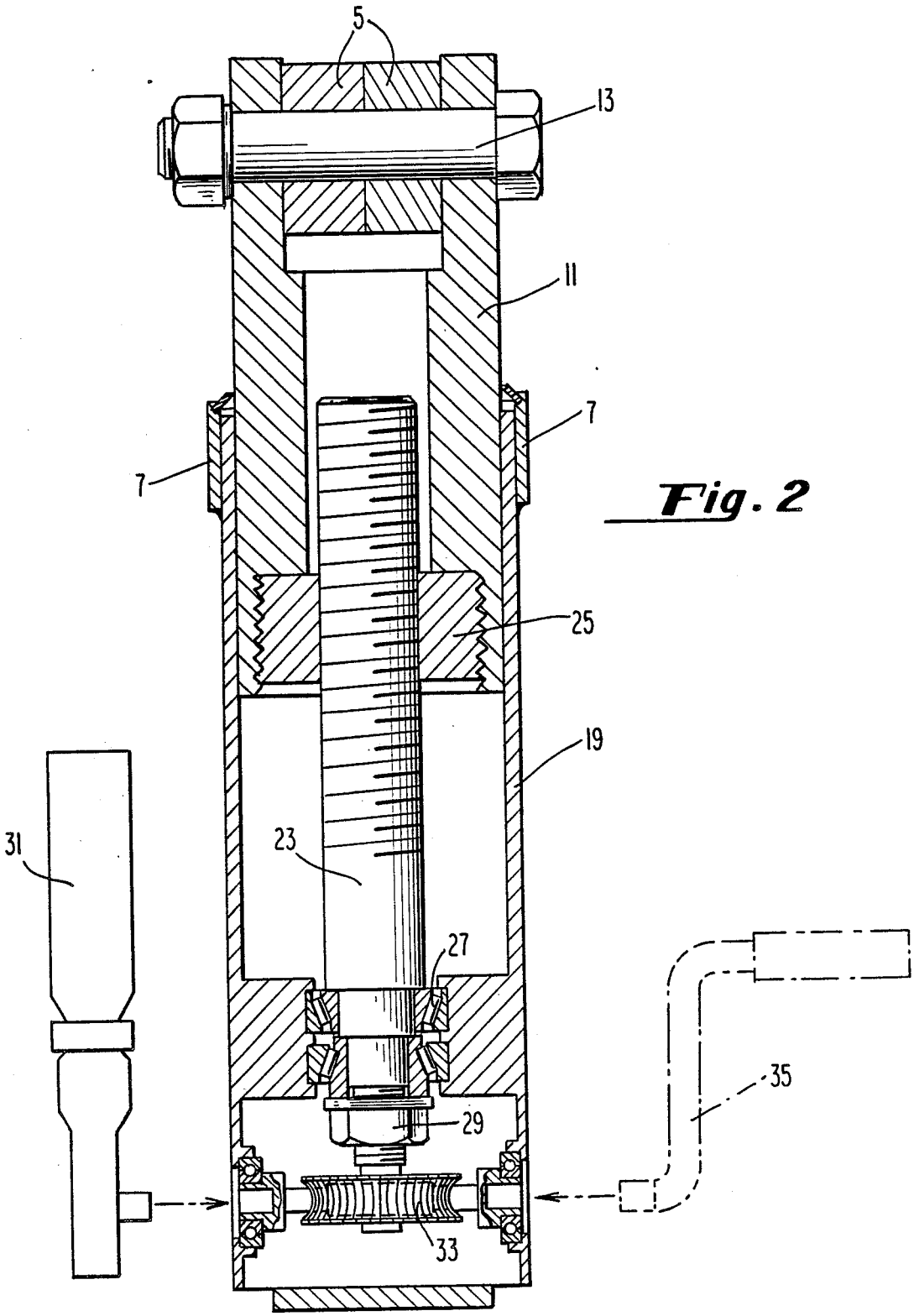
FIG. 2 is a cross-sectional view, taken along the line 2—2 of FIG. 1, and showing details of the drive mechanism of the invention.

FIG. 1 shows the general form of the rescue tool of the present invention, with the significant internal components shown in dotted outline. FIG. 2 shows the latter components in more detail.

As shown in FIGS. 1 and 2, rescue tool 1 includes handle 3 and arms 5. The arms are pivotably mounted together, and connected by bolt 13. The arms are connected to piston 11, which is movable back and forth within cylinder 19, as shown by arrow 21. The arms are also connected, by links 9, to a fixed yoke 7.

In the embodiment shown, cylinder 19 comprises a frame for the rescue tool. The drive components of the tool are mounted within this frame. Other frame structures are possible.

Although cylinder 19 is, in most cases, of circular cross-section, it is possible to make its cross-section non-circular, if desired. Such modifications are within the scope of the invention.

When piston 11 moves upward, as shown in FIG. 1, the arms are forced apart, and move towards the position indicated by dotted line 15. When the piston moves downward, the arms come together, to the position indicated by dotted lines 17. The movements of the piston and arms are similar to those described in the above-cited patents.

Located in the interior of cylinder 19 is threaded member 23. The threaded member threadedly engages collar 25, which is securely and nonthreadedly engaged with piston 11. The threads on collar 25 which engage threaded member 23 are not shown. The attachment of collar 25 to piston 11 is shown as a mating sawtooth structure. Any other rigid means of fastening the collar and the piston, such as welding or other means, can be used.

Threaded member 23 is journaled within bearings 27, and is anchored to the cylinder by nut 29. Threaded member 23 can rotate, but cannot move along its longitudinal axis. Therefore, when threaded member 23 rotates, collar 25 moves along the length of the threaded member, and pushes or pulls piston 11 with it. Thus, rotation of the threaded member causes arms 5 to separate or come together.

In one embodiment, the external power source for the tool is motor 31. The motor can be pneumatically, hydraulically, or electrically powered. In the embodiment shown in FIGS. 1 and 2, the power from the motor is transmitted to the threaded member through bevel gear 33.

It is also possible to operate the rescue tool manually, using hand crank 35. Hand operation is feasible because of the inherent mechanical advantage of the threaded drive. If the threads of the threaded member are spaced reasonably closely, each turn of the crank will cause only a miniscule displacement of the threaded member. Thus, not only can the tool be operated by hand, but the arms can be moved with great precision, without danger of jerking or overshooting.

Figure 3:
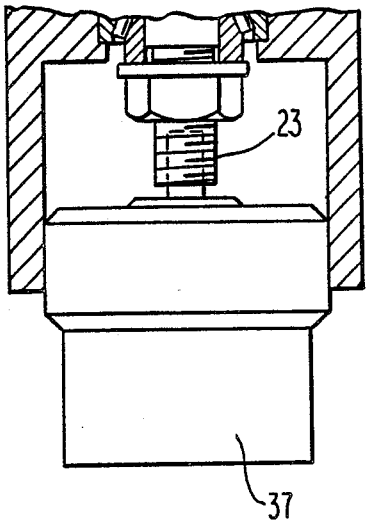
FIG. 3 is a fragmentary view, showing an alternative embodiment of the invention, wherein an external power source directly drives the threaded member.

FIG. 3 illustrates an alternative embodiment wherein the power source drives the threaded member directly, without a bevel gear. Motor 37 is shown connected directly to threaded member 23. It is also possible to connect a hand crank in the same manner.

Threaded collar 25 can be any structure which threadedly engages member 23. However, it is preferred that the collar be made so as to minimize friction and thereby increase efficiency. In the preferred embodiment, the threaded collar includes a friction-reducing device, such as a ball screw or roller screw. Such low-friction devices are commercially available.

The invention can operate with virtually any type of power source. Because the interior structure of the rescue tool is the same regardless of the type of power source used, one can connect the same tool to different power sources at different times, without modifying the rescue tool at all. Also, there is no need for an intermediate power unit; the motor can be connected directly to the tool.

The present invention also has the advantage that the power generated is the same for both directions of movement of the arms. The direction of movement of the arms depends only on the direction of rotation of the threaded member. In the prior art, the power available for one direction may not equal the power available for the other.

Although the rescue tool of the present invention can be used with the same motors used with rescue tools of the prior art, it is possible to use smaller motors, due to the mechanical advantage conferred by the threaded drive. The threaded member converts a given amount of power into a very small displacement of the arms of the tool. One can compensate for the relatively low power of the motor by operating the motor for a somewhat longer time.

The rescue tool of the present invention allows very precise cutting, because the movements of the arms are precisely controlled by the threaded member. One achieves the advantage of precision not only when the tool is powered by hand, but also when it is powered by a motor. The threaded drive tends to prevent the arms from jerking suddenly when power is applied.

While the invention has been described with respect to particular embodiments, it is understood that many other variations are possible. The particular shape and arrangement of the arms, piston, and yoke are exemplary and not limiting; many other configurations of these components are possible. Also, the details of the anchoring and engagement of the threaded member with the piston, or its equivalent, can be varied. The arms can include blades, or can be attached to blades. The arms can also have other attachments, such as the work jaws described above. Also, if the jaws and arms are removed, the piston is still movable. In the latter case, the tool can be used as a ram. These and other modifications should be deemed within the spirit and scope of the following claims.

What is claimed is:

1. A method of operating a rescue tool, for extricating an accident victim from the wreckage of an accident, the rescue tool having a pair of arms which are pivotably connected together, and a piston means connected to the arms, such that movement of the piston means causes the arms to separate and come together, the method comprising the step of turning a threaded member, the member being threadedly engaged with the piston such that rotation of the threaded member causes the piston means to move, by direct mechanical coupling and without the intervention of a fluid medium, and thereby to move the arms, the turning step being performed until the arms have moved to a desired position, wherein the turning step comprises the steps of bringing a power source to the vicinity of the threaded member, the power source being entirely distinct from the rescue tool, such that the power source is capable of turning the threaded member, and activating the power source so as to turn the threaded member.

2. In a method of operating a rescue tool for the extrication of accident victims from wreckage of accidents, the tool having a pair of arms capable of being moved apart and together, the arms being connected to a reciprocating means, the reciprocating means being moved so as to cause the arms to move apart and together, the improvement wherein the arms are moved by turning a threaded member, the member being threadedly engaged with the reciprocating means, the threaded member being turned until the arms have moved to a desired position, wherein the turning step comprises the steps of bringing an independent power source to the vicinity of the threaded member, the power source being entirely distinct from the rescue tool, such that the power source is capable of turning the threaded member, and activating the power source so as to turn the threaded member.

3. The method of claim 1, wherein the turning step is preceded by the step of selecting the power source from the group consisting of an electric motor, a hydraulic motor, and a pneumatic motor.

4. The method of claim 2, wherein the turning step is preceded by the step of selecting a power source from the group consisting of an electric motor, a hydraulic motor, and a pneumatic motor.

5. A method of operating a rescue tool, for extricating an accident victim from the wreckage of an accident, the rescue tool having a pair of arms which are pivotable connected together, and a piston means connected to the arms, such that movement of the piston means causes the arms to separate and come together, the method comprising the steps of choosing a type of power source, bringing the power source to the vicinity of the rescue tool, the power source being entirely distinct from the rescue tool, and causing the power source to turn a threaded member, the member being threadedly engaged with the piston such that rotation of the threaded member causes the piston means to move, by direct mechanical coupling and without the intervention of a fluid medium, and thereby to move the arms, the turning being performed until the arms have moved to a desired position.

6. The method of claim 5, wherein the choosing step comprises the step of selecting the power source from the group consisting of an electric motor, a hydraulic motor, and a pneumatic motor.

* * * * *